US006369017B1

(12) United States Patent
Shubkin et al.

(10) Patent No.: US 6,369,017 B1
(45) Date of Patent: Apr. 9, 2002

(54) COMPOSITIONS FOR SURFACE CLEANING IN AEROSOL APPLICATIONS

(75) Inventors: Ronald L. Shubkin; Eric W. Liimatta, both of Baton Rouge, LA (US)

(73) Assignee: Albemarle Corporation, Richmond, VA (US)

( * ) Notice: Subject to any disclaimer, the term of this patent is extended or adjusted under 35 U.S.C. 154(b) by 0 days.

(21) Appl. No.: 09/792,559

(22) Filed: Feb. 23, 2001

Related U.S. Application Data

(63) Continuation of application No. 09/151,822, filed on Sep. 11, 1998, now Pat. No. 6,258,770.

(51) Int. Cl.[7] ..... C11D 7/30; C11D 7/50

(52) U.S. Cl. ..... 510/412; 510/365; 510/408; 252/364; 134/40

(58) Field of Search ..... 252/364, 372, 252/67; 516/10; 134/40, 42; 510/412, 273, 365, 408

(56) References Cited

U.S. PATENT DOCUMENTS

| | | | | |
|---|---|---|---|---|
| 3,238,137 | A | 3/1966 | Grammer et al. | 252/171 |
| 3,397,148 | A | 8/1968 | Grammer et al. | 252/171 |
| 3,629,128 | A | 12/1971 | Rains | 252/171 |
| 5,073,206 | A | 12/1991 | Wilson et al. | 134/40 |
| 5,403,507 | A | 4/1995 | Henry | 252/170 |
| 5,492,645 | A | 2/1996 | Oshima et al. | 252/171 |
| 5,616,549 | A | 4/1997 | Clark | 510/412 |
| 5,665,170 | A | 9/1997 | Lee et al. | 134/19 |
| 5,707,954 | A | 1/1998 | Lee | 510/412 |
| 5,792,277 | A | 8/1998 | Shubkin et al. | 134/19 |
| 5,824,162 | A | 10/1998 | Clark | 134/31 |
| 5,858,953 | A | 1/1999 | Aman et al. | 510/412 |

FOREIGN PATENT DOCUMENTS

| | | |
|---|---|---|
| GB | 2286405 | 8/1995 |
| JP | 867643 | 3/1996 |
| WO | 9732964 | 9/1997 |
| WO | 9816617 | 4/1998 |

*Primary Examiner*—Yogendra N. Gupta
*Assistant Examiner*—Gregory E. Webb
(74) *Attorney, Agent, or Firm*—E. E. Spielman, Jr.

(57) ABSTRACT

When certain weight ratios of certain flammable additive components (an ether and an epoxyalkane) are blended in n-propyl bromide, the components can actually function as flame retardants or flame suppressants when the resulting cleaning composition is used in aerosol applications. The proportions of the additives used are small; yet suitably effective stabilization against metallic corrosion is achieved even at mildly elevated temperatures.

23 Claims, No Drawings

COMPOSITIONS FOR SURFACE CLEANING IN AEROSOL APPLICATIONS

REFERENCE TO RELATED APPLICATIONS

This is a continuation of commonly owned copending Continued Prosecution Application (CPA) No. 09/151,822 U.S. Pat No. 6,258,770, which continues the prosecution of prior commonly-owned copending application Ser. No. 09/151,822, filed Sept. 11, 1998.

TECHNICAL FIELD

This invention relates to novel, high performance solvent compositions which can be used safely in aerosol applications for cleaning surfaces, such as metal surfaces.

BACKGROUND

Recently, n-propyl bromide has been shown to be an excellent substitute for chlorinated hydrocarbons as a cleaning and degreasing solvent.

U.S. Pat. No. 5,707,954 describes stabilized degreasing and cleaning solvent compositions which are comprised of at least 90 wt % of n-propyl bromide and a 1,4-dioxane-free stabilizer system which comprises 2,2-dialkoxypropane. The stabilizer system may contain in addition a nitroalkane, nitrobenzene, an epoxide such as 1,2-epoxybutane, and/or an amine. Efficacious results are shown in the example wherein a solvent composition was composed of the following ingredients: 96.5 wt % of n-propyl bromide, 2.5 wt % of 2,2-dimethoxypropane, 0.5 wt % of 1,2-epoxybutane, and 0.5 wt % of nitromethane. The patent also describes, inter alia, tests involving replacement of the 2.5 wt % of 2,2-dimethoxypropane by 2.5 wt % of 1,3-dioxolane or 2.5 wt % of 1,4-dioxane.

THE INVENTION

In one of its aspects, this invention involves the surprising discovery that when certain weight ratios of certain flammable additive components are blended in n-propyl bromide, the components can actually function as flame retardants or flame suppressants when the resulting composition is used in aerosol applications. Thus, even though the composition is in a highly dispersed or aerosol state—a condition which normally engenders increased flammability—the composition is more flame resistant than if the particular flammable additive ingredients had not been blended in the n-propyl bromide.

Another aspect of this invention is the discovery that certain very small amounts of flammable additives when blended in n-propyl bromide provide suitably effective stabilization against metallic corrosion even at mildly elevated temperatures. Indeed, this advantageous result can be achieved by use of very small concentrations of but two additives in the n-propyl bromide.

Accordingly, this invention provides, in one of its embodiments, a composition which comprises (I) n-propyl bromide having dissolved therein (ii) an ether, preferably a cyclic diether having a 5- or 6-membered ring, and most preferably 1,3-dioxolane, and (iii) an epoxyalkane having in the range of 3 to about 7 carbon atoms in the molecule, preferably 1,2-epoxybutane, in proportions such that said composition is nonflammable under the conditions of ASTM test procedure D 3065 using 1-fluoro-2,2,2-trifluoroethane as the propellant.

Another embodiment of this invention is a method of reducing the flammability of n-propyl bromide in aerosol applications (when tested under the conditions of ASTM test procedure D 3065 using 1-fluoro-2,2,2-trifluoroethane as the propellant), which method comprises blending with the n-propyl bromide (i) in the range of about 0.1 to about 1 wt % of an ether, preferably a cyclic diether having a 5- or 6-membered ring, and most preferably 1,3-dioxolane, and (ii) in the range of about 0.02 to about 0.5 wt % of an epoxyalkane having in the range of 3 to about 7 carbon atoms in the molecule, preferably 1,2-epoxybutane. Said weight percentages are based on the total weight of the n-propyl bromide and components (i) and (ii). Preferably, the weight ratio of (i):(ii) is in the range of about 1:1 to about 5:1.

Still another embodiment of this invention is a stabilized solvent composition comprising a solvent portion which includes at least 90 wt % of n-propyl bromide and a stabilizer system consisting essentially of (i) in the range of about 0.1 to about 1 wt % based on the total weight of the composition, of an ether, preferably a cyclic diether having a 5- or 6-membered ring, and most preferably 1,3-dioxolane, and (ii) in the range of about 0.02 to about 0.5 wt % based on the total weight of the composition, of an epoxyalkane having in the range of 3 to about 7 carbon atoms in the molecule, preferably 1,2-epoxybutane. Said weight percentages are based on the total weight of the n-propyl bromide and components (i) and (ii). Preferably the weight ratio of (i):(ii) is in the range of about 1:1 to about 5:1.

As regards reduced flammability, when the above proportions of the flammable additives (the ether and the epoxyalkane) are blended into n-propyl bromide, and the mixture is combined with a component which functions as a propellant and utilized as an aerosol, the flammability of the resulting formulation can be significantly decreased relative to essentially additive-free n-propyl bromide combined with the same component that functions as the propellant. In addition, such proportions of the flammable additives provide effective stabilization against metal corrosion even though in preferred formulations the composition is devoid of a nitroalkane or a nitroaromatic hydrocarbon such as nitrobenzene. At the same time the efficacy of the composition as a solvent is maintained.

Pursuant to an additional embodiment, this invention provides a method for cleaning a surface which method comprises applying to the surface a composition in the form of an aerosol spray, such composition being comprised of solvent portion which includes at least 90 wt % of n-propyl bromide and a stabilizer system consisting essentially of (i) in the range of about 0.1 to about 1 wt % of an ether, preferably a cyclic diether having a 5- or 6-membered ring, and most preferably 1,3-dioxolane, and (ii) in the range of about 0.02 to about 0.5 wt % of an epoxyalkane having in the range of 3 to about 7 carbon atoms in the molecule, preferably 1,2-epoxybutane. Said weight percentages are based on the total weight of the n-propyl bromide and components (i) and (ii). Preferably the weight ratio of (i):(ii) is in the range of about 1:1 to about 5:1.

The above and other embodiments of this invention will be apparent from the ensuing description and the appended claims.

The compositions of this invention contain at least 90 wt %, preferably at least about 95 wt %, and more preferably at least about 98 wt % of n-propyl bromide. Most preferably the composition is formed from n-propyl bromide that has a purity of at least 99 wt %, where such wt % refers to percent of n-propyl bromide plus impurities, if any. n-Propyl bromide is available commercially from Albemarle Corporation of Richmond, Virginia, and from other commercial sources.

In the practice of this invention use is made of ethers that are soluble in the solvent portion of the composition. Thus, use can be made of aliphatic, aromatic and cyclic ethers, which can be either monoethers or polyethers that are suitably soluble in n-propyl bromide. Suitable ethers include, but are not limited to, diethyl ether, dipropyl ether, dibutyl ether, methyl tert-butyl ether, ethyl tert-butyl ether, tert-amyl methyl ether, anisole, tetrahydrofuran, tetrahydropyran, the methyltetrahydrofurans, and similar monoethers. Among suitable polyethers are such materials as 1,2-methoxyethane, the dimethyl ether of diethylene glycol, the dimethyl ether of triethylene glycol, the dimethyl ether of tetraethylene glycol, 1,4-dioxane, 1,3-dioxolane, 2-methyl-1,3-dioxolane, and an analogous polyether solvents. Particularly desirable ethers are cyclic diethers such as 1,4-dioxane and 1,3- dioxane, and especially 1,3-dioxolane and alkyl substituted 1,3-dioxolanes. Particularly preferred as the ether component is 1,3-dioxolane. The ether component is used in amounts ranging from about 0.1 to about 1.0 wt %, preferably in the range of about 0.2 to about 0.5 wt %, and most preferably of the range of about 0.3 to about 0.5 wt %. Said weight percentages are based on the total weight of the n-propyl bromide, ether, and epoxyalkane components.

The other additive component required in the compositions of this invention is an epoxyalkane having from 3 to about 7 carbon atoms in the molecule. Suitable epoxides include, but are not limited to, 1,2-epoxypropane, 1,2-epoxybutane, 2,3-epoxybutane, 1,2-epoxypentane, 2,3-epoxypentane, 1,2-epoxyhexane, 2,3-epoxyhexane, 4-methyl-1,2-epoxypentane, 1,2-epoxyheptane, 2,3-epoxyheptane, 3,4-epoxyheptane, cyclohexene oxide, glycidyl methyl ether, and the like. Preferred epoxides are the linear 1,2-epoxyalkanes having from 3 to about 7 carbon atoms in the molecule, and most preferred is 1,2-epoxybutane. The epoxide is used in amounts of about 0.02 wt % to about 0.5 wt %. Preferably the epoxide is used in an amount in the range of about 0.1 to about 0.3 wt %. Said weight percentages are based on the total weight of the n-propyl bromide, ether, and epoxyalkane components.

Preferred proportions of the ingredients in the compositions of this invention are 98.75 to 99.75 wt % of n-propyl bromide; 0.10 to 1.00 wt % of the ether component; and about 0.15 to about 0.25 wt % of the epoxyalkane component. Most preferred is about 0.15 to about 0.20 wt % of the epoxyalkane, e.g., 1,2-epoxybutane. Most preferably the n-propyl bromide has a purity of at least about 99%.

Other additives can be included in the compositions of this invention provided they do not materially detract from the flame suppressant or stabilization performance characteristics of the compositions. Preferably the compositions are devoid of any additive ingredient(s) other than one or more ethers and one or more epoxyalkanes (except for the propellant).

The aerosol containers with which the compositions of this invention are employed in aerosol spray applications are pressurized aerosol spray containers in which a propellant is used. Such devices are known and described in the literature. Any suitable propellant of relatively low flammability can be used to pressurize the aerosol spray container, such as, for example, fluorocarbons, fluorohalocarbons, fluorohydrocarbons, and fluorohalohydrocarbons with suitably high vapor pressures including bromochlorodifluoromethane, 1,1,1-trifluoroethane, 1,1,1,2-tetrafluoroethane, dichlorofluoromethane, dichlorodifluoromethane, chlorotrifluoromethane, trichlorofluoromethane, sym-tetrachlorodifluoroethane, 1,2,2-trichloro-1,1,2-trifluoroethane, and sym-dichlorotetrafluoroethane, and mixtures thereof. When using 1-fluoro-2,2,2-trifluoroethane as the propellant, the wt % ratio of 1-fluoro-2,2,2-trifluoroethane to the sum of the n-propyl bromide, the ether, and the epoxyalkane in the cleaning composition is preferably at least about 30/70. Said wt % ratio is most preferably in the range of about 30/70 to about 40/60.

The solvent compositions of the invention have particular utility in non-spark-free applications and environments as aerosol spray cleaning compositions. Preferably, the surface to be cleaned in the presence of potential ignition sources such as electrical switches or the like should be at a relatively low temperature such as from about 25° C. to about 60° C. The aerosol spray discharge is applied to the surface. The discharge functions as a cleaner, and is either removed, as by wiping with a cloth, or is allowed to drip off.

The following demonstrates the exceptional non-flammability and non-corrosiveness of the solvent compositions of this invention. The examples are not intended to constitute limitations on the invention, but rather are presented for purposes of illustration.

EXAMPLE I

A solvent composition was prepared by mixing the following ingredients together:

99.4 wt % of n-propyl bromide 0.4 wt % of 1,3-dioxolane 0.2 wt % of 1,2-epoxybutane The solvent composition was combined with propellant HFC-134a (1-fluoro-2,2,2-trifluoroethane) in the weight ratios listed in the Table. The solvent-propellant combination was confined to twelve-ounce cans in ten-ounce portions. The sample was then subjected to a Flame Extension Test set forth in Consumer Products Safety Commission regulations on hazardous substance (16 CFR 1500.45–46), which is also ASTM test procedure D 3065. In the test, a methanol burner with a 2350 wipe in the lid to act as a wick was used a source of ignition. The discharge from the aerosol can was sprayed through the top third of the burner flame from a distance of 6 inches continually until the can was empty. The results of the tests are summarized in the Table.

TABLE

| Substance tested | N-propyl bromide:1-fluoro-2,2,2-trifluoroethane (wt %:wt %) | Flame extension |
|---|---|---|
| Pure n-propyl bromide* (NPB) | 70:30 | 10 inches |
| NPB with stabilizers of Example 1 | 70:30 | 6 inches |
| Pure n-propyl bromide* (NPB) | 68:32 | 10 inches |
| NPB with stabilizers of Example 1 | 68:32 | 3 inches |

*contains 0.15 wt % 1,2-epoxybutane

EXAMPLE II

A solvent composition was prepared containing 0.4 wt % of 1,3-dioxolane, 0.15 wt % of 1,2-epoxybutane, and 99.45 wt % of n-propyl bromide. A piece of tin-plated carbon steel of the grade used for industrial aerosol containers was subjected to Military Specifications Test no. MIL-T-81533A 4.4.9. In this test 0.5-inch by 5-inch panels of aerosol-can grade metal are polished with a No. 1 cloth until the panels are free from tarnish or oxide residue. Panels are then washed with detergent and water, rinsed with distilled water, then acetone, and allowed to dry. The panels are placed in a 500 ml Erlenmeyer flask with a ground glass neck, and covered to a depth of 1 inch with the above n-propyl bromide formulation. The resultant test sample is refluxed for 24 hours over a light shielded 150 watt light bulb. The panel is removed, rinsed with refluxate, and examined for corrosion. It was found that the test panel that had been refluxed with the above n-propyl bromide formulation exhibited no observable corrosion.

It is to be understood that the reactants and components referred to by chemical name or by formula anywhere in the specification or claims hereof, whether referred to in the singular or plural, are identified as they exist prior to coming into contact with another substance referred to by chemical name or chemical type (e.g., another reactant, a solvent, or etc.). It matters not what preliminary chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together in connection with performing a desired chemical reaction or in forming a mixture to be used in conducting a desired reaction. Accordingly, even though the claims hereinafter may refer to substances, components and/or ingredients in the present tense ("comprises," "is," etc.), the reference is to the substance, component or ingredient just as it existed at the time just before it was first contacted, blended or mixed with one or more other substances, components and/or ingredients in accordance with the present disclosure. Thus, the fact that a substance, component or ingredient may have lost its original identity through a chemical reaction or transformation through the course of contacting, blending or mixing operations, if conducted in accordance with this disclosure and with the application of common sense and the ordinary skill of a chemist, is thus wholly immaterial for an accurate understanding and appreciation of the true meaning and substance of this disclosure and the claims thereof.

Each and every patent or publication referred to in any portion of this specification is incorporated in toto into this disclosure by reference, as if fully set forth herein.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A spray dispenser containing a composition devoid of nitroalkane and devoid of nitroaromatic hydrocarbon, said composition comprising (i) a solvent portion in which the solvent consists of n-propyl bromide of a purity of at least 99 wt % having dissolved therein a stabilizer system consisting essentially of (a) 1,3-dioxolane and (b) one or more epoxyalkanes having in the range of 3 to about 7 carbon atoms in the molecule, in proportions such that said composition is rendered more flame resistant when in the form of a spray dispersed in air under the conditions of ASTM test procedure D 3065 and when using 1,1,1,2-tetrafluoroethane as the propellant for said composition in said test procedure.

2. A spray dispenser of claim 1 wherein (a) is present in an amount in the range of about 0.1 to about 1 wt %, and (b) is present in an amount in the range of about 0.02 to about 0.5 wt %, both such percentages being based on the total weight of said n-propyl bromide plus the weights of (a) and (b).

3. A spray dispenser of claim 1 wherein (b) is 1,2-epoxybutane.

4. A spray dispenser of claim 1 wherein the weight ratio of (a):(b) is in the range of about 1:1 to about 5:1.

5. A spray dispenser of claim 1 wherein the concentration of (a) is in the range of about 0.2 to about 0.5 wt %, and the concentration of (b) is in the range of about 0.15 to about 0.25 wt %, said percentages being based on the total weight of the n-propyl bromide and of components (a) and (b).

6. A spray dispenser of claim 1 wherein said composition consists essentially of about 99.40 wt % of n-propyl bromide, about 0.40 wt % of 1,3-dioxolane, and about 0.20 wt % of 1,2-epoxybutane.

7. A spray dispenser of claim 1 wherein said composition consists essentially of about 99.45 wt % of n-propyl bromide, about 0.40 wt % of 1,3-dioxolane, and about 0.15 wt % of 1,2-epoxybutane.

8. A spray dispenser as in any of claims 1 or 3, 7 wherein the dispenser is a pressurized dispenser containing a propellant of low flammability.

9. A spray dispenser of claim 1 or 2 wherein said dispenser is a pressurized dispenser containing a propellant consisting of 1,1,1,2-tetrafluoroethane.

10. A spray dispenser of claim 1 wherein said dispenser is a pressurized dispenser containing as the propellant one or a mixture of propellants selected from fluorocarbons, fluorohalocarbons, fluorohydrocarbons, and fluorohalohydrocarbons.

11. A spray dispenser of claim 1 or 2 wherein said dispenser is a pressurized dispenser containing as the propellant, a propellant selected from the group consisting of bromochlorodifluoromethane, 1,1,1-trifluoroethane, dichlorofluoromethane, dichlorodifluoromethane, chlorotrifluoromethane, trichlorofluoromethane, symtetrachlorodifluoroethane, 1,2,2-trichloro-1,1,2-trifluoroethane, and symdichlorotetrafluoroethane, and mixtures thereof.

12. A method of cleaning a surface, which method comprises applying to said surface as an aerosol spray, a composition devoid of nitroalkane and devoid of nitroaromatic hydrocarbon, said composition comprising (i) a solvent portion in which the solvent consists of n-propyl bromide of a purity of at least 99 wt % having dissolved therein (ii) a stabilizer system consisting essentially of (a) 1, 3 dioxolane and (b) one or more epoxyalkanes having in the range of 3 to about 7 carbon atoms in the molecule, in proportions such that said composition is rendered more flame resistant when in the form of a spray dispersed in air under the conditions of ASTM test procedure D 3065 and when using 1,1,1,2-tetrafluoroethane as the propellant for said composition in said test procedure.

13. A method of claim 12 wherein said composition is applied as the aerosol spray discharge from an aerosol dispenser in which 1,1,1,2-tetrafluoroethane is the propellant, and wherein the wt % ratio of 1,1,1,2-tetrafluoroethane to the sum of the n-propyl bromide, the ether, and the epoxyalkane is about 30/70 or higher.

14. A method of claim 2 wherein said composition is applied as the aerosol spray discharge from an aerosol dispenser in which one or a mixture of propellants of low flammability selected from fluorocarbons, fluorohalocarbons, fluorohydrocarbons, and fluorohalohydrocarbons is the propellant.

15. A method of claim 14 wherein said propellant is selected from bromochlorodifluoromethane, 1,1,1-trifluoroethane, dichlorofluoromethane, dichlorodifluoromethane, chlorotrifluoromethane, trichlorofluoromethane, sym-tetrachlorodifluoroethane, 1,2,2-trichloro- 1,1,2-trifluoroethane, and sym-dichlorotetrafluoroethane, and mixtures thereof.

16. A method of claim 12 wherein said composition is devoid of any additive component other than (a), (b), and if used, a propellant.

17. A method of claim 12 wherein the amount of (a) in said composition is in the range of about 0.2 to about 0.5 wt %, and the amount of (b) is in the range of about 0.15 to about 0.25 wt %, said percentages being based on the total weight of the n-propyl bromide and of components (a) and (b).

18. A method of claim 12 wherein said composition consists essentially of about 99.40 wt % of said n-propyl bromide, about 0.40 wt % of 1,3-dioxolane, and about 0.20 wt % of 1,2-epoxybutane.

19. A method of claim 12 wherein said composition consists essentially of about 99.45 wt % of said n-propyl bromide, about 0.40 wt % of 1,3-dioxolane, and about 0.15 wt % of 1,2-epoxybutane.

20. A composition devoid of nitroalkanes and devoid of nitroaromatic hydrocarbons, said composition consisting essentially of about 98.75 to about 99.75 wt % of n-propyl bromide, about 0.10 to about 1.00 wt % of 1,3-dioxolane, and about 0.15 to about 0.25 wt % of 1,2-epoxybutane, the total of said weight percentages being 100 wt %.

21. A composition of claim 20 wherein said composition consists essentially of about 99.40 to about 99.45 wt % of n-propyl bromide, about 0.40 wt % of 1,3-dioxolane, and about 0.15 to about 0.20 wt % of 1,2-epoxybutane, the total of said weight percentages being 100 wt %.

22. A composition of claim 21 wherein said composition consists essentially of about 99.40% of n-propyl bromide, about 0.40 wt % of 1,3-dioxolane, and about 0.20 wt % of 1,2-epoxybutane.

23. A composition of claim 21 wherein said composition consists essentially of about 99.45% of n-propyl bromide, about 0.40 wt % of 1,3-dioxolane, and about 0.15 wt % of 1,2-epoxybutane.

* * * * *

UNITED STATES PATENT AND TRADEMARK OFFICE

CERTIFICATE OF CORRECTION

PATENT NO. : 6,369,017 B1
DATED : April 9, 2002
INVENTOR(S) : Ronald L. Shubkin et al.

It is certified that error appears in the above-identified patent and that said Letters Patent is hereby corrected as shown below:

Column 6,
Line 62, reads "...claim 2…" and should read -- ...claim 12… --

Column 7,
Line 5, reads "...sym-terachlorodifluoroethane…" and should read
-- ...symterachlorodifluoroethane… --

Signed and Sealed this

Twelfth Day of April, 2005

JON W. DUDAS
*Director of the United States Patent and Trademark Office*